US006620023B2

(12) United States Patent
Yeung

(10) Patent No.: US 6,620,023 B2
(45) Date of Patent: Sep. 16, 2003

(54) MODEL CAR WITH TILT AND LIFT SUSPENSION

(75) Inventor: Bill Yeung, Kowloon (HK)

(73) Assignee: Radio Shack, Corp., Fort Worth, TX (US)

( * ) Notice: Subject to any disclaimer, the term of this patent is extended or adjusted under 35 U.S.C. 154(b) by 38 days.

(21) Appl. No.: 09/916,907

(22) Filed: Jul. 27, 2001

(65) Prior Publication Data

US 2003/0022589 A1 Jan. 30, 2003

(51) Int. Cl.[7] ..... A63H 17/26
(52) U.S. Cl. ..... 446/466; 446/456; 446/465
(58) Field of Search ..... 446/465, 466, 446/469, 437, 456, 454

(56) References Cited

U.S. PATENT DOCUMENTS

| | | | | | |
|---|---|---|---|---|---|
| 2,026,181 | A | * | 12/1935 | Kennedy | 446/444 |
| 2,216,497 | A | * | 10/1940 | McHenry | 446/466 |
| 3,619,940 | A | * | 11/1971 | Good et al. | 446/469 |
| 3,721,042 | A | * | 3/1973 | Marason, Jr. | 446/465 |
| 4,254,577 | A | * | 3/1981 | Cheng | 446/444 |
| 4,374,548 | A | * | 2/1983 | Ueno et al. | 180/266 |
| 4,596,534 | A | * | 6/1986 | Ishimoto | 446/466 |
| 4,696,655 | A | * | 9/1987 | D'Andrade et al. | 446/466 |
| 4,892,502 | A | * | 1/1990 | Hesse | 446/465 |
| 5,312,288 | A | * | 5/1994 | Williams | 446/466 |
| 5,322,469 | A | * | 6/1994 | Tilbor | 446/466 |
| 5,334,077 | A | * | 8/1994 | Bailey | 446/466 |
| 5,449,311 | A | * | 9/1995 | Williams | 446/466 |
| 5,482,494 | A | * | 1/1996 | Ishimoto | 446/466 |
| 5,527,059 | A | * | 6/1996 | Lee, Jr. | 446/466 |
| 5,722,872 | A | * | 3/1998 | Simmons et al. | 446/466 |
| 5,785,576 | A | * | 7/1998 | Belton | 446/466 |
| 6,036,575 | A | * | 3/2000 | Rehkemper et al. | 446/466 |
| 6,106,362 | A | * | 8/2000 | Keller et al. | 446/456 |
| 6,383,054 | B1 | * | 5/2002 | Rauch | 446/466 |
| 2002/0061710 | A1 | | 5/2002 | Wong | |
| 2002/0077026 | A1 | | 6/2002 | Li | |
| 2002/0086611 | A1 | | 7/2002 | Nava | |

FOREIGN PATENT DOCUMENTS

| | | | | | |
|---|---|---|---|---|---|
| GB | 2130904 | A | * | 6/1984 | A63H/17/36 |

* cited by examiner

*Primary Examiner*—Derris H. Banks
*Assistant Examiner*—Urszula M Cegielnik
(74) *Attorney, Agent, or Firm*—Benman, Brown & Williams; Daniel R. Brown

(57) ABSTRACT

A model vehicle that operates to emulate "hydraulics" in a full size vehicle is taught. A suspension lift function and a suspension tilt function are produced though implementation of suspension apparatus. A wheel carriage is coupled to a chassis and the movement therebetween is controlled by one or more actuators. Either lift or tilt, or both, movement may be employed. In an illustrative embodiment, rotational movement is employed to effect lift and tilt, along perpendicular axis defined by a sub-chassis. A first actuator works between the chassis and sub-chassis, and a second actuator works between the sub-chassis and a wheel carriage. Control may be remote, utilizing wired, radio, sonic, or infrared remote control schemes.

18 Claims, 11 Drawing Sheets

MODEL CAR WITH TILT AND LIFT SUSPENSION

BACKGROUND OF THE INVENTION

1. Field of the Invention

The present invention relates to model vehicles. More specifically, the present invention relates to remote controlled model cars with controllable suspension position and suspension action.

2. Description of the Related Art

Model cars, trucks, and other vehicles are produced in a variety of sizes and configurations. Models are used for display, demonstration, research, marketing, recreational, and many other applications. One popular form of models is the remotely controlled model. Remote control is typically implemented through radio transmissions, cable interconnections, or infrared light beams. Within the model are motors and servomotor controllers (called "servos") that motivate and articulate the model. These actions produce forward and reverse motion, steering, and other actions within such models.

Model vehicles commonly mimic full size, or real, vehicles in their scale, function, and application. Although, it is also common to see model vehicles designed with futuristic, fictitious, or even fantasy designs. The vehicle used as the reference design may be thought of as an exemplar for the model vehicle. In the case of remote controlled model vehicles that are used for recreational activities, designers are continually seeking new and appealing designs so as to stimulate interest in such models. For example, in the case of a popular movie that features a fantasy vehicle prop, it is not uncommon for designers of model vehicles to style a product in accordance with the movie prop. Another example is the case where model designers refer to the latest products produced by the automotive industry as exemplars. Similarly, competitive racing vehicles are sometimes used as exemplars for remote control models. Popular culture and the after market auto industry also produce creatively modified vehicles that can be exemplars.

The after market automotive parts industry and the popular culture have produced certain modified vehicles that employ hydraulic power to allow the user to dynamically configure the vehicle suspension so that the body of the vehicle can be placed in a variety of unusual positions. This technique is commonly referred to as "hydraulics". In application, a hydraulic pump is driven by the vehicle's engine or an electric motor powered by batteries and the hydraulic power produced is used to drive hydraulic actuators through a hydraulic valve body. The hydraulic actuators are linked to the vehicle suspension, typically at the four wheel anchor locations. By actuation of controls on the hydraulic valve body, the hydraulic actuators adjust the suspension height at one or more of the four wheels so that the vehicle can be raised, lower, or tilted in a variety of configurations.

From a marketing perspective, it is desirable to produce a remote controlled model that employs the hydraulics used in the popular culture. However, this is problematic as the cost and complexity of scaling a hydraulic system to a model vehicle is very high. Thus, there is a need in the art for a remote controlled vehicle that mimics the "hydraulic" functions seen in the popular culture.

SUMMARY OF THE INVENTION

The need in the art is addressed by the apparatuses of the present invention. A first illustrative embodiment teaches a model vehicle having a suspension operable to vary the lift of the vehicle which closely emulates the "hydraulic" lift associated with full size motored vehicles. The apparatus includes a chassis and a lift carriage that are rotatably coupled together about a laterally aligned lift axis. Also, a wheel axle rotatably supported by the lift carriage and oriented parallel to the lift axis, and a lift actuator coupled to the chassis and the lift carriage, such that actuation varies the angle of rotation of the lift carriage. The rotation causes the chassis to lift up and down with respect to the wheels attached to the wheel axle, that naturally rest on firm ground.

The foregoing apparatus is improved upon wherein the lift actuator further includes a cam follower and a motor driven cam aligned to rotatably engage the cam follower, thereby producing an oscillating rotation about the lift axis when the motor operates. In another refinement to this, the cam has an eccentric shape. In a further refinement, a remote control receiver is coupled to energize the motor driven cam upon receipt of a lift command. In a further refinement, the apparatus includes a remote control unit that has a lift input actuator, such as a push button, coupled to a remote control transmitter, such that actuation of the lift input actuator causes the transmitter to transmit a lift command to the remote control receiver. In a further refinement, the remote control transmitter transmits the lift command by radio signal. In a further refinement, the apparatus further includes a spring disposed between the chassis and the lift carriage, which is arranged to urge rotation about the lift axis in opposition to rotation by the lift actuator.

In another illustrative embodiment of the present invention a model vehicle has a suspension that operates to vary the tilt of the vehicle, which emulates the tilting action imparted to full size vehicles that employ "hydraulics". In this embodiment, the apparatus includes a chassis and a tilt carriage that is rotatably coupled to the chassis about a longitudinally aligned tilt axis. Also, a wheel axle rotatably supported by the tilt carriage and oriented perpendicularly with respect to the tilt axis, and, a tilt actuator coupled to the chassis and the tilt carriage, such that actuation varies the angle of rotation of the tilt carriage. This causes the chassis to tilt left or tilt right with respect to the wheels and ground.

In a refinement to the foregoing apparatus, the tilt carriage is rotatably coupled to the chassis by a combination tilt bearing and tilt shaft. In a further refinement, the tilt actuator is a servo coupled to the chassis and the tilt carriage that operates to impart rotation about the tilt axis. In a further refinement, the apparatus further includes a remote control receiver coupled to control the tilt servo upon receipt of a tilt commands. In a further refinement, the apparatus also includes a remote control unit that has a first tilt input actuator coupled to a remote control transmitter, and arranged such that actuation of the first tilt input actuator causes the transmitter to transmit a first tilt command. In a further refinement, the remote control transmitter transmits the tilt commands by radio signal. In a further refinement, the first tilt command causes the tilt servo to rotate in a first direction, such as the clockwise direction. And, the remote control transmitter further includes a second input tilt actuator coupled to the remote control transmitter, such that actuation of the second tilt input actuator causes the transmitter to transmit a second tilt command. The second tilt command causes the servo to rotate in a second direction, such as the counter-clockwise direction. In a further refinement, the chassis has a guide slot arcuately formed into it at a constant distance from the tilt axis, and the tilt carriage has a guide boss that extends to rotatably engage the guide slot.

Another illustrative embodiment of the present invention combines the lift and tilt actions to teach a very realistic and complex lift and tilt capability, as in full size vehicles the employ "hydraulics". The apparatus of this embodiment includes a chassis and a sub-chassis. The sub-chassis defines a first axis aligned substantially perpendicular to a second axis. It also includes a rotatable coupling between the chassis and the sub-chassis aligned with the first axis, and a first actuator coupled to the chassis and the sub-chassis. Actuation of the first actuator varies the angle of rotation of the sub-chassis about the first axis. The apparatus also includes a wheel carriage that is rotatably coupled to the sub-chassis about the second axis. Also, a second actuator coupled to the sub-chassis and the wheel carriage, such that actuation thereof varies the angle of rotation of the wheel carriage about the second axis.

In a refinement to the foregoing embodiment, the second actuator further includes a cam follower and a motor driven cam aligned to rotatably engage the cam follower. This arrangement produces an oscillating rotation about the second axis when the motor operates. The improvement further teaches that the first actuator includes a servo coupled to the chassis and the sub-chassis to impart rotation therebetween about the first axis. In a further refinement, the cam is eccentric. In a further refinement, the apparatus further includes a spring disposed between the sub-chassis and the wheel carriage that is arranged to urge rotation about the second axis in opposition to rotation by the second actuator. In a further refinement, the sub-chassis is rotatably coupled to the chassis about the first axis by a combination bearing and shaft. In a further refinement, the chassis has at least a first guide slot arcuately formed therein about a constant radius from the first axis, and, the sub-chassis has at least a first guide boss extending therefrom that rotatably engages the at least a first guide slot. In a further refinement, the apparatus further includes a remote control receiver coupled to energize the motor upon receipt of a lift command, and coupled to control the servo upon receipt of one or more tilt commands. In a further refinement, the apparatus further includes a remote control transmitter unit with a lift input actuator coupled to the remote control transmitter, such that actuation of the lift input actuator causes the transmitter to transmit a lift command. Also, a first tilt input actuator coupled to the remote control transmitter, such that actuation of the first tilt input actuator causes the transmitter to transmit a first tilt command. In another refinement, the remote control transmitter transmits the lift command and the tilt commands by radio signal. In another refinement, the first tilt command causes the tilt servo to rotate in a first direction, and the remote control transmitter further includes a second input tilt actuator coupled to the remote control transmitter. Actuation of the second tilt input actuator causes the transmitter to transmit a second tilt command, and the second tilt command causes the servo to rotate in a second direction.

The present invention also teaches a broader application of the novel teachings, which provides a model vehicle having a suspension that operates to vary the lift of the vehicle. This apparatus includes a chassis, a wheel carriage, and a lift actuator coupled to the chassis and the wheel carriage, such that actuation thereof varies the lift of the chassis.

The present invention also teaches a broader application of the novel teachings, which provides a model vehicle that has a suspension that operates to vary the tilt of the vehicle. This apparatus includes a chassis, a wheel carriage, and a tilt actuator coupled to the chassis and the wheel carriage, such that actuation thereof varies the tilt of the chassis.

The present invention also teaches a broader application of the novel teachings, which provides a model vehicle that has a suspension that operates to vary the tilt and the lift of the vehicle. This apparatus includes a chassis and a wheel carriage. In addition, a first actuator coupled to vary the tilt between the chassis and wheel carriage, and, a second actuator coupled to vary the lift between the chassis and the wheel carriage.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
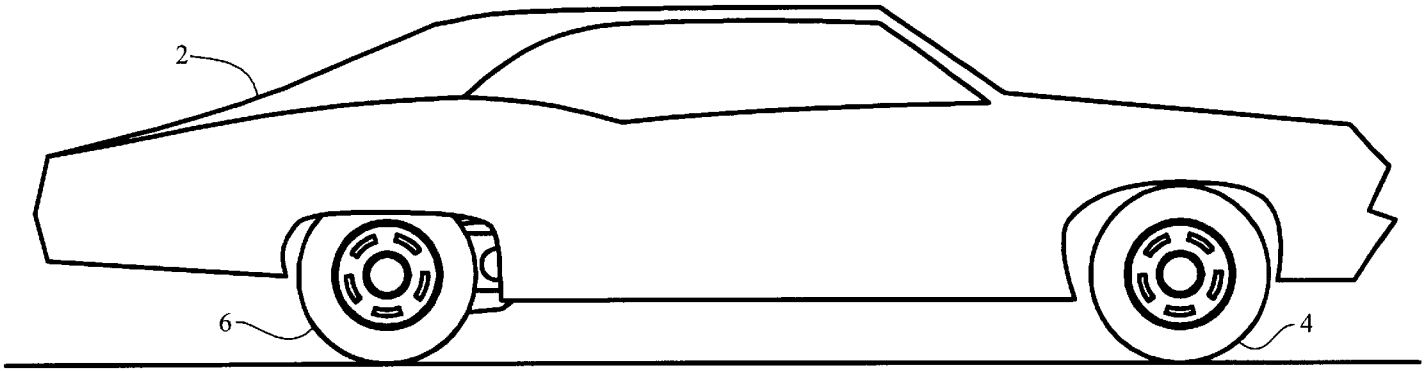
FIG. 1 is a side view of a model car in the lowered position according to an illustrative embodiment of the present invention.

Reference is now directed to FIG. 1, which is a side view of a model car 2 in the lowered position according to an illustrative embodiment of the present invention. In this illustrative embodiment, the lift and tilt capabilities are adapted to the rear axle and wheels 6, as well is the primary drive motor of the model. However, the teachings of the present invention are equally applicable to the front axle and wheels 4, as well as to axles and wheels that are not driven by the primary drive motor. In fact, the teachings of the present invention can readily be applied to both axles and all the wheels of a model car. Or, for other varieties of model vehicles, the teachings can be applied to any of a plurality of axles and wheels. Since the popular culture generally applies "hydraulics" to cars, the illustrative embodiment is also directed to a conventional four wheel, two axle, and rear wheel drive, automobile. FIG. 1 generally illustrates the suspension position of the lift capability of the model vehicle when the suspension lift is set to the lowest position.

Figure 2:
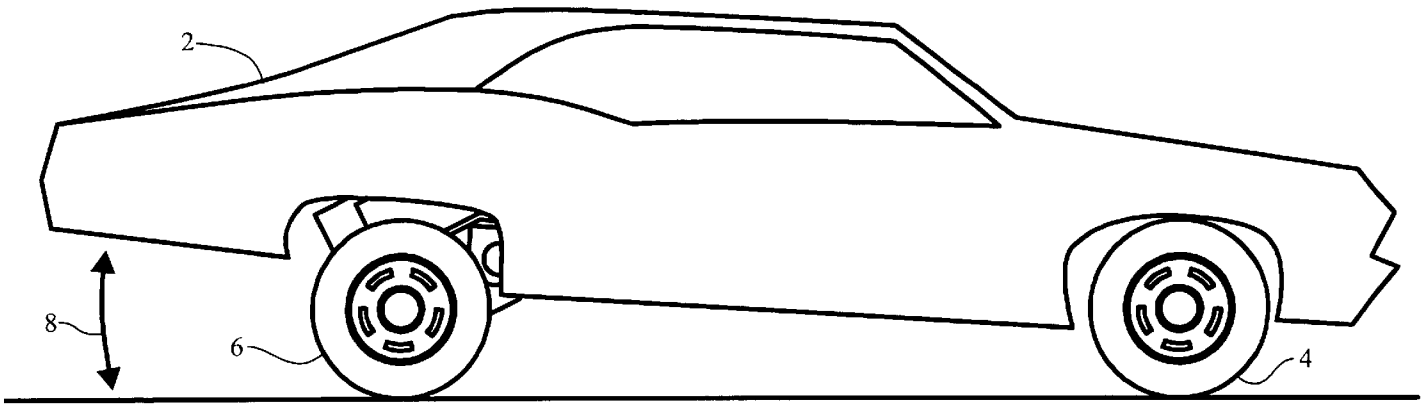
FIG. 2 is a side view of a model car in the raised position according to an illustrative embodiment of the present invention.

FIG. 2 is a side view of the model car 2 in the raised position according to the illustrative embodiment of the present invention. The front wheels 4 remain in the same position relative to the vehicle chassis. The suspension has been adjusted to lift the vehicle by extending the position of the rear wheels 6 away from the chassis by a distance illustrated by arrow 8. The suspension lift adjustment thus performs the same dynamic function as do the "hydraulics" in a full size vehicle when both wheels on a single axle are extended by the same distance of suspension travel. FIG. 2 generally illustrates the suspension lift when set to its maximum distance.

Figure 3:
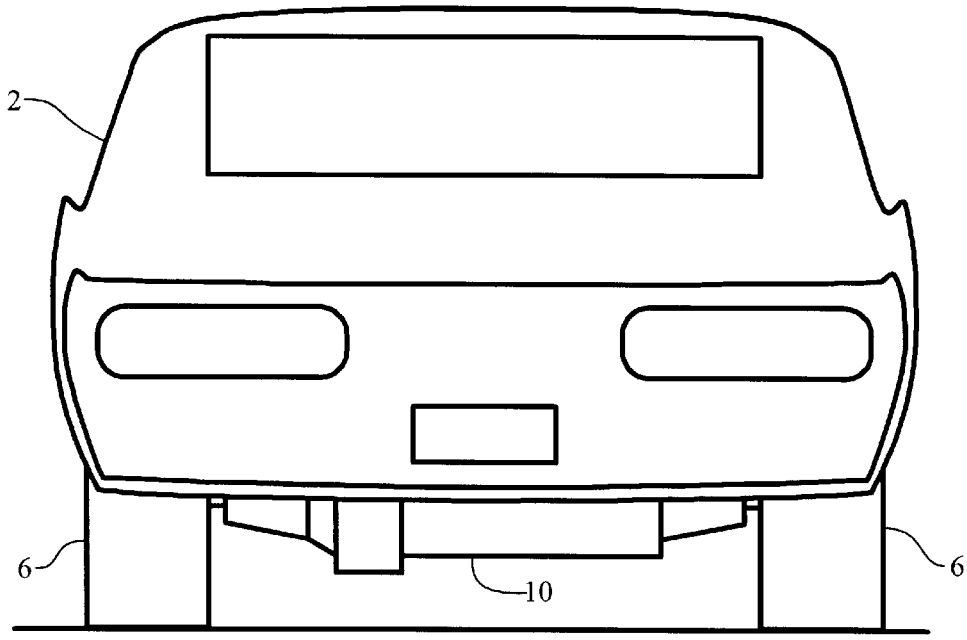
FIG. 3 is a back view of a model car in the lowered position according to an illustrative embodiment of the present invention.

FIG. 3 is a back view of the model car 2 with the suspension lift set to the lowered position according to the illustrative embodiment of the present invention. The rear wheels 6 are visible and are coupled to a rear wheel carriage 10, which also comprises the rear axle and primary drive motor.

Figure 4:
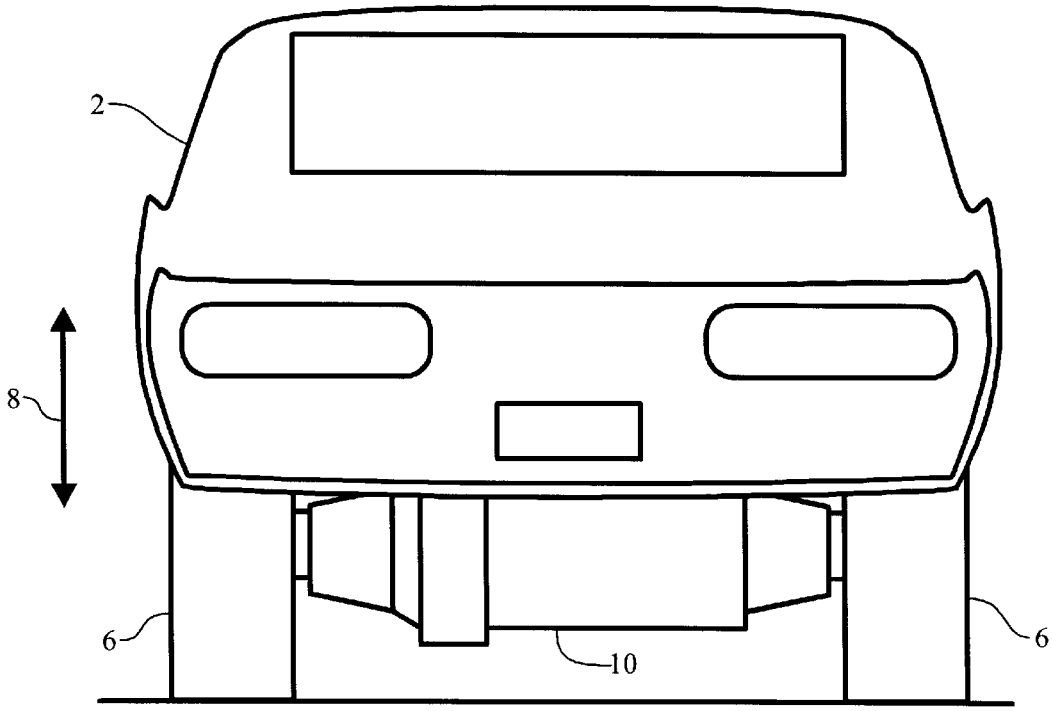
FIG. 4 is a back view of a model car in the raised position according to an illustrative embodiment of the present invention.

FIG. 4 is a back view of the model car 2 with the suspension lift set to the raised position according to an illustrative embodiment of the present invention. A greater portion of the rear wheels 6 are visible in this view, as well a greater portion of the rear wheel carriage 10 is visible. The travel of the suspension lift is illustrated by arrow 8.

Figure 5:
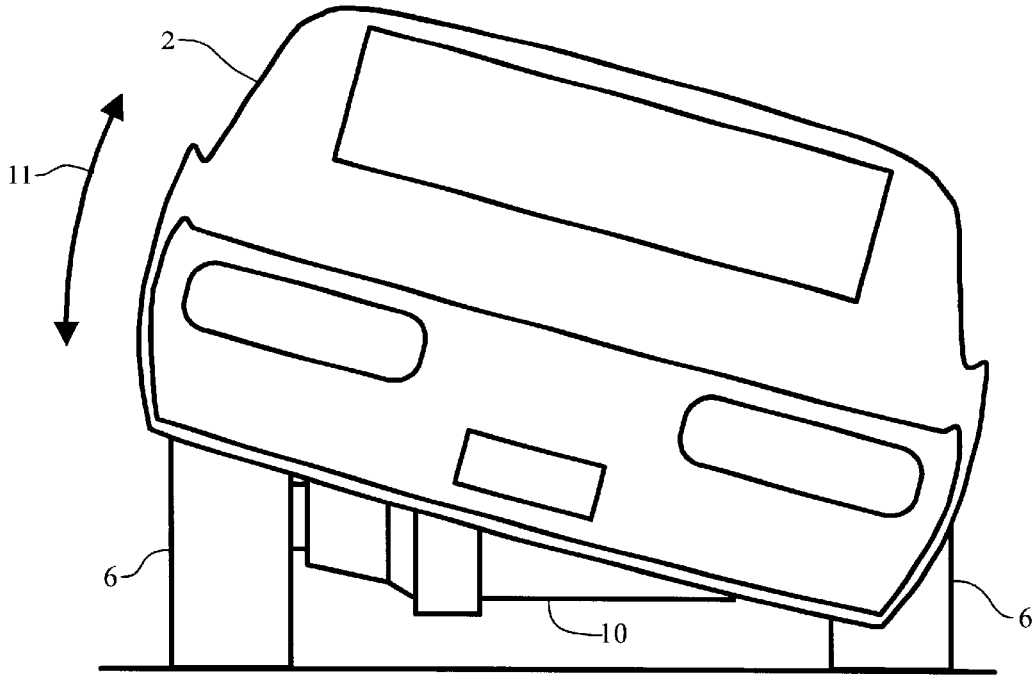
FIG. 5 is a back view of a model car tilted to the right in the lowered position according to an illustrative embodiment of the present invention.

In addition to the suspension lift adjustment discussed and illustrated above, the present invention teaches a suspension tilt action. In the case of "hydraulics" applied to a full size vehicle, tilt is achieved by applying different suspension travel settings to two wheels on a single axle, or different axles. Thus, the vehicle leans to one side or the other, and therefore tilts. Reference is directed to FIG. 5, which is a back view of the model car 2 tilted to the right with the lift set to the lowered position according to the illustrative embodiment of the present invention. FIG. 5 illustrates both of the lift and tilt actions of the illustrative embodiment. The rear wheels 6 naturally rest on the ground, coupled together by an axle that is rotatably supported by the rear wheel carriage 10. The tilt and lift suspension adjustments set the model car 2 in a low position, tilted to the right. The tilt motion is illustrated by arrow 11 in FIG. 5. Of course, tilt can also be applied in the opposite direction, tilting the vehicle to the left. The techniques applied to achieve this result will be more fully described hereinafter. It should be noted that the reaction caused about the front axle and wheels of the vehicle are dependent upon the degree of compliance of the front suspension. If the compliance in the front suspension is large, then both of the front wheels will remain on contact with the ground. However, if the compliance of the front suspension is small, the limited suspension travel of the front suspension will cause one of the front wheels to float above the ground when the rear suspension is fully tilted. This action can be desirable as it dynamically demonstrates the extreme degree of tilt applied by the vehicle's suspension.

Figure 6:
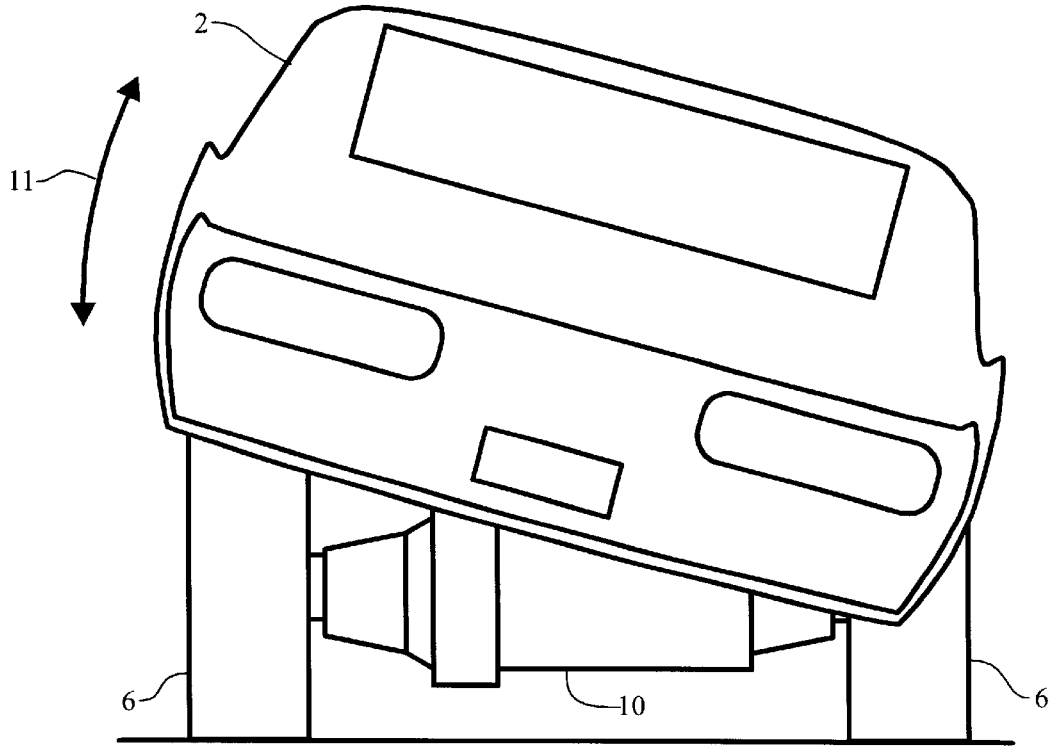
FIG. 6 is a back view of a model car tilted to the right in the raised position according to an illustrative embodiment of the present invention.

FIG. 6 is a back view of the model car 2 tilted to the right while the suspension lift is set to its maximum extended position. This combination causes a great degree of suspension extension and yields a dramatically altered vehicle position, or stance. The rear wheels 6 are exposed, particularly the left wheel when tilted to the right, and the right wheel when tilted to the left. The rear wheel carriage 10 is also more exposed. The tilting motion 11 is the same as in FIG. 5, however it occurs in the higher, lifted, position. The combination of various lift settings and various tilt settings, whether to the left or right, yields a great range of "hydraulic" action to the model vehicle. If similar adjustments are applied to both the front and rear axles, the effect becomes extreme, and impressive. As will be discussed more fully below, the adjustments to lift and tilt can be made dynamically together with steering, and forward and reverse movement of the model vehicle. The total effect is a model car the closely emulates a full size vehicle operating on a roadway that employs normal driving functions with "hydraulic" suspension action.

As was discussed earlier, applying hydraulic power to a model vehicle is complex and cost prohibitive from a practical perspective. Yet, it is desirable to produce such a product for the reasons previously discussed. The present invention achieves this goal by applying other kinds of actuators (e.g. non-hydraulic) to various suspension geometries to yield "hydraulic" action. Model vehicles that operate independently, or by remote control, typically employ electrical or electronic control systems. In some instances, internal combustion engines are employed as the primary motive force, however, electrical and electronic circuits are still used for control. The following paragraphs detail an illustrative embodiment approach to achieving "hydraulic" action in a model vehicle. Those of ordinary skill in the art will appreciate that various other combinations of non-hydraulic actuators and various other suspension geometries could be employed to achieve "hydraulic" action and that such approaches would fall within the scope of the present invention.

Figure 7:
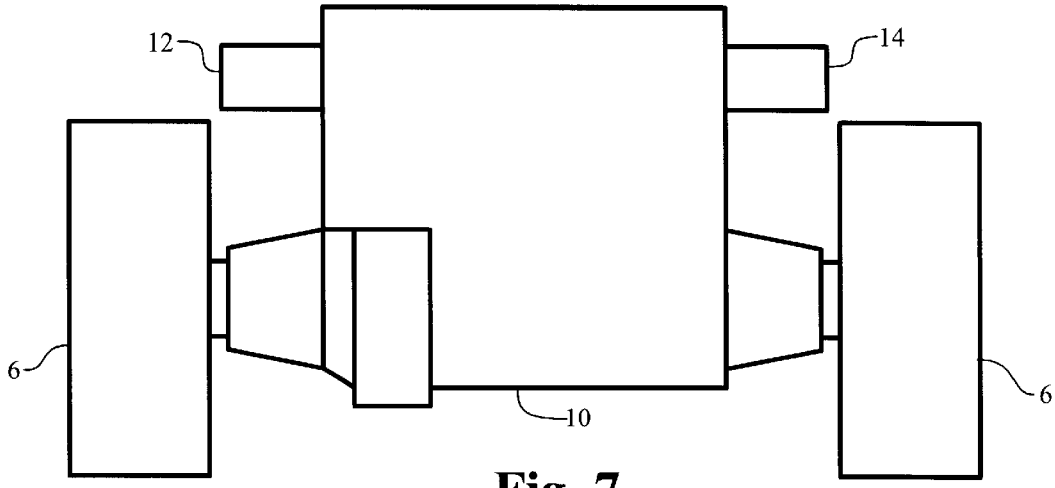
FIG. 7 is a top view of the drive motor assembly according to an illustrative embodiment of the present invention.
Figure 8:
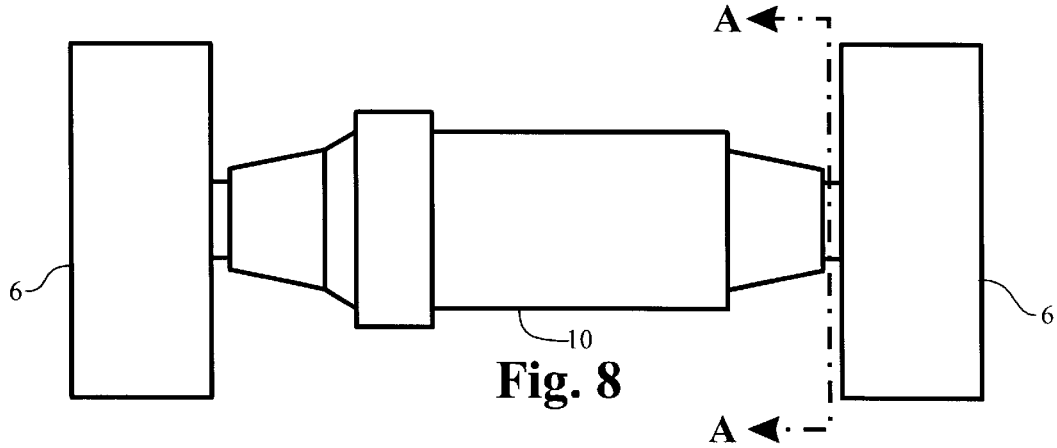
FIG. 8 is a back view of the drive motor assembly according to an illustrative embodiment of the present invention.
Figure 9:
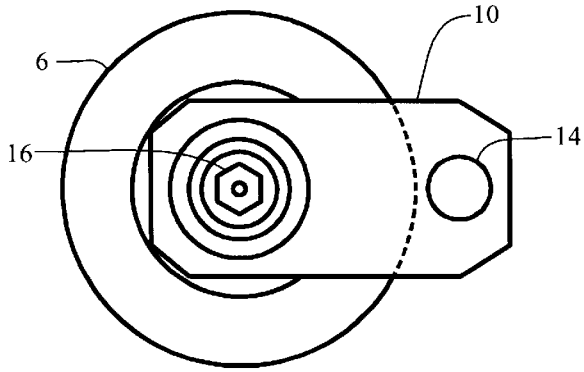
FIG. 9 is a side section view (along sections line "A—A" from FIG. 8) of the drive motor assembly according to an illustrative embodiment of the present invention.

FIGS. 7, 8, and 9 illustrate three views of rear wheel carriage 10 and its related components (collectively the drive motor assembly) in an illustrative embodiment of the present invention. The references to front, back, rear, side, top, left, right, and etc. employed in this description are consistent with the convention notions when applied to a vehicle. So too are the notions of longitudinal, lateral, and vertical, as used herein. In particular, FIG. 7 is a top view of the drive motor assembly according to an illustrative embodiment of the present invention. The rear wheel carriage 10 houses the primary drive motor (not shown) that provides forward and reverse direction motion of the model vehicle. An axle (not shown) is rotatably coupled to and passes through he rear wheel carriage 10 and connects to the two rear wheels 6, and, delivers power to the rear wheels 6 as well. Drive motor and axle combinations are understood by those having ordinary skill in the art. In the illustrative embodiment, the rear axle is disposed toward the rear end of the rear wheel carriage 10. The direction of the axle is longitudinal with respect to the vehicle chassis. The rear wheel carriage 10 has a first shaft extension 12 and a second shaft extension 14 that extend from the rear wheel carriage 10 and which define a lift axis. The direction of the lift axis is substantially parallel to the rear axle in the illustrative embodiment. As will become clear below, it is the rotation of the rear wheel carriage 10 about the lift axis that controls the lift action of the vehicle.

FIG. 8 is a rear view of the drive motor assembly according to the illustrative embodiment of the present invention. The rear wheel carriage 10 is visible, so too are the rear wheels 6. FIG. 9 is a side section view (along sections line "A—A" from FIG. 8) of the drive motor assembly according to the illustrative embodiment of the present invention. The rear wheel carriage 10 is shown, with most of the left rear wheel 6 visible behind rear wheel carriage 10. The axle 16 extension is visible, which is the point on the axle to which the rear wheel 6 is attached. The right side shaft extension 14, which forms the lift axis is also visible. Rotation of the rear wheel carriage 10 about the lift axis, with respect to the vehicle chassis is used to accomplish the lift action in the illustrative embodiment. The rotational movement is accomplished by employing an actuator. In the illustrative embodiment, this actuator (not shown in FIG. 9) is rigidly coupled to the rear wheel carriage 10.

Figure 10:
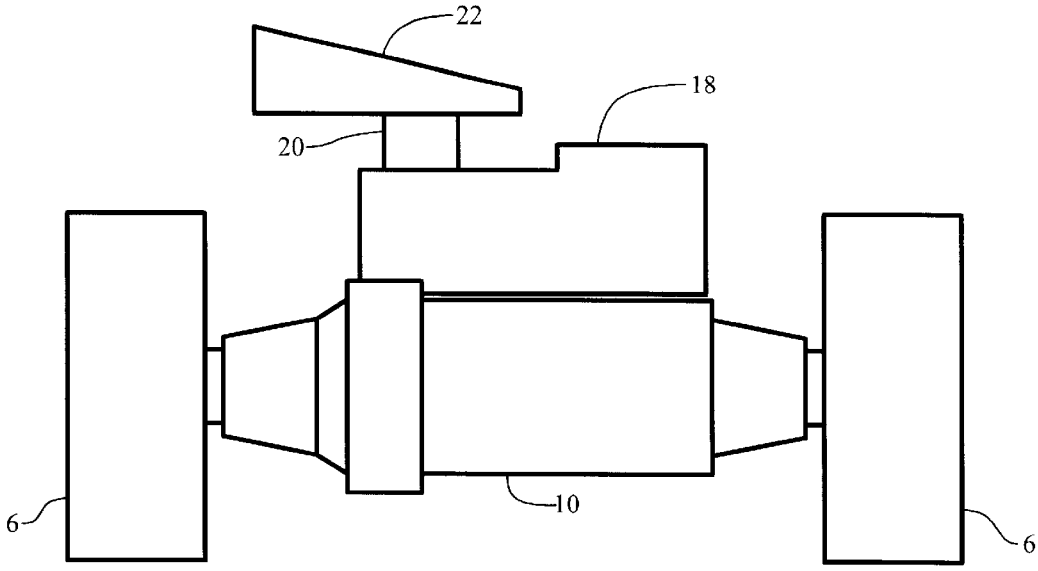
FIG. 10 is a back view of the drive motor assembly with the lift motor in place according to an illustrative embodiment of the present invention.
Figure 11:
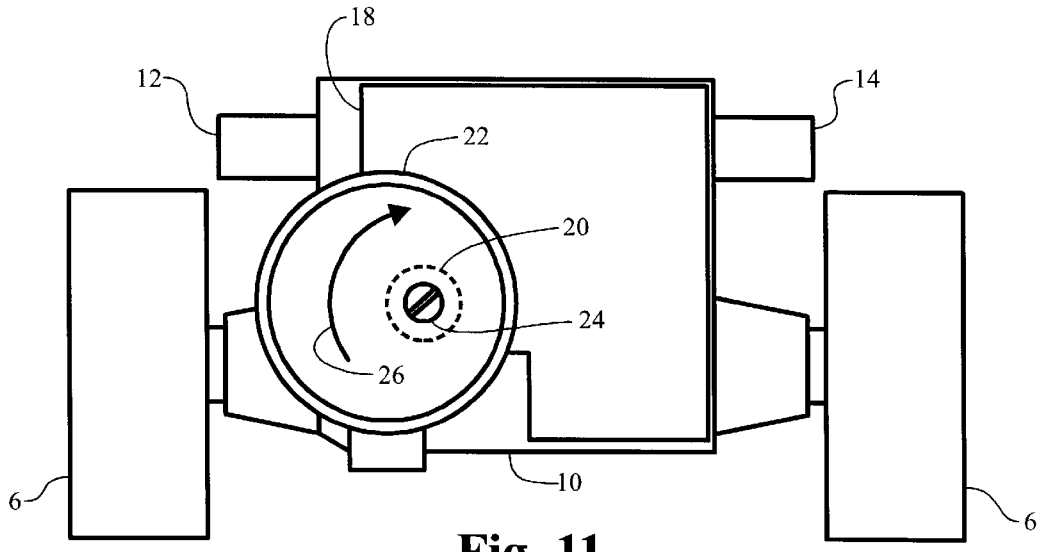
FIG. 11 is a top view of the drive motor assembly with the lift motor in place according to an illustrative embodiment of the present invention.

FIG. 10 is a rear view of the drive motor assembly showing rear wheel carriage 10 with a portion of the tilt actuator affixed thereto. The lift actuator in the illustrative embodiment is a motor with a cam and cam follower. The lift motor is item 18 in FIG. 10. In FIG. 10, the rear wheel carriage 10 is visible with the rear wheels 6 attached thereto. The lift motor 18 is rigidly coupled to the rear wheel carriage 10. The lift motor 18 presents a shaft extension 20 that rotates when the lift motor is energized. The shaft extension 20 is coupled to a rotary cam 22. FIG. 11 is a top view of the drive motor assembly showing rear wheel carriage 10 with the lift motor 18 in place. The rear wheel carriage 10 is visible below the lift motor 18. So too are the rear wheels 6 visible as well as the lift axis shaft extensions 12 and 14, which were discussed herein before. The lift motor shaft extension 20 is shown in phantom for reference. The rotary cam 22 is attached to the lift motor shaft extension 20 with a screw fastener 24. The rotation of the rotary cam is indicated by arrow 26. In the illustrative embodiment, the rotary cam 22 is eccentric with respect to the lift motor shaft 20, and the purpose for this will be discussed below. Also, it is only necessary for the lift motor 18 to turn in a single direction since a full oscillation of the lift raise-lower cycle is accomplished in each revolution of the lift motor 18 and rotary cam 22.

Figure 12:
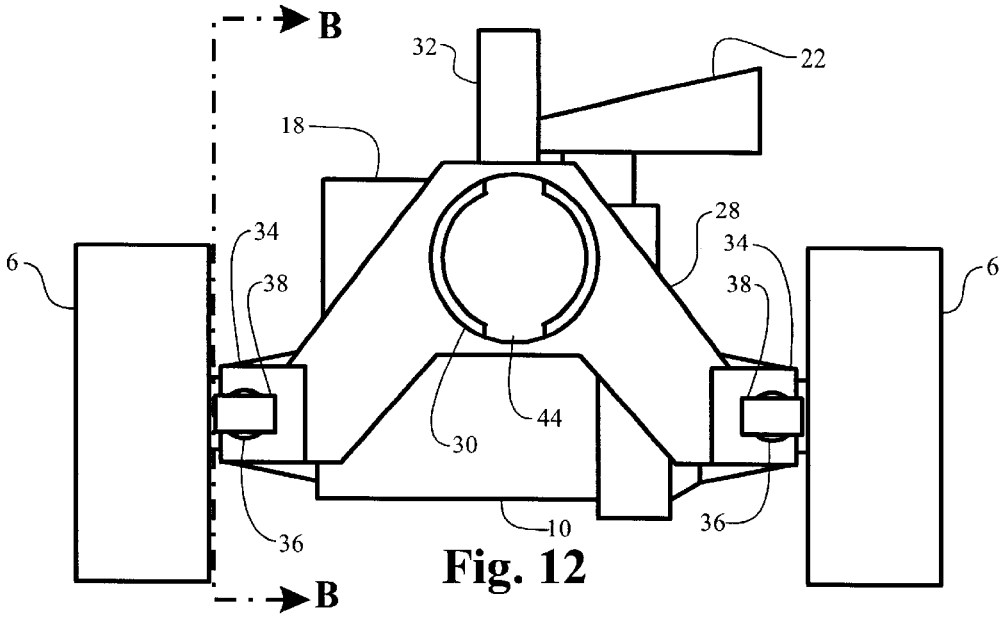
FIG. 12 is a front view of the drive motor assembly and lift motor coupled to the tilt carriage according to an illustrative embodiment of the present invention.

Reference is directed to FIG. 12, which is a front view of the drive motor assembly showing rear wheel carriage 10 and lift motor 18 coupled to a tilt carriage 28 according to an illustrative embodiment of the present invention. The tilt carriage 28 is rotatably coupled to the lift shaft extensions 12 and 14 (which are not visible in FIG. 12) on the rear wheel carriage 10. The coupling is accomplished by inserting the lift shaft extensions 12 and 14 into bearing journals on lift arm extension 34 on the tilt carriage 28. As noted above, the rotation about the lift axis causes the lift action in the illustrative embodiment. The essential function of the tilt carriage 28 is to rotatably (around a longitudinal axis) couple to the vehicle chassis (not shown in FIG. 12) and to rotatably (around a lateral axis) couple to the rear wheel carriage 10. The tilt carriage 28 may also be referred to as a sub-chassis. The two axis of rotation (the lateral lift axis and the longitudinal tilt axis) are located at substantially a right angle to one another. In addition, the tilt carriage 28 includes a cam follower 46 (not shown in FIG. 12) that is supported by cam arm extension 32 to engage the rotary cam 22. The combination of the lift motor 18, the rotary cam 22, and the cam follower 46 form the lift actuator in the illustrative embodiment.

The lift actuator in the illustrative embodiment utilizes a rotary cam system. However, those of ordinary skill in the art will appreciate that there are a many different kinds of actuators that could be employed to achieve this needed control. A linear actuator, such as a solenoid or screw actuator could be employed. So too could a rotary actuator, such as a steering servo be employed. The use of any such actuator means is intended to fall within the scope of the claims of the present invention.

Again referring to FIG. 12, the tilt carriage 28 includes a tilt shaft 30 that extends along the longitudinal axis and has a slot 44 at its distal end for engaging a tilt actuator (not shown). The front surface of the tilt carriage has two guide bosses 36 that are terminated with guide tabs 38. As will become apparent hereinafter, these guide bosses engage guide slots in the chassis to stabilize and strengthen the tilt axis motion.

Figure 13:
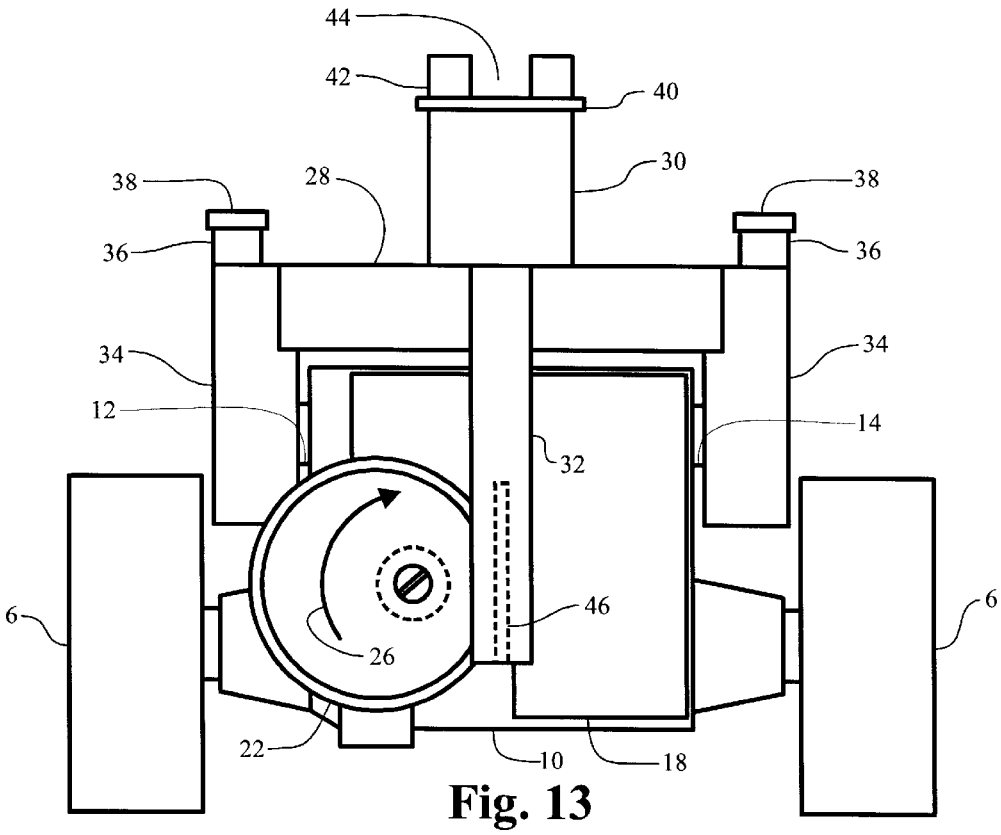
FIG. 13 is a top view of the drive motor assembly and lift motor coupled to the tilt carriage according to an illustrative embodiment of the present invention.

FIG. 13 is a top view of the drive motor assembly showing the rear wheel carriage 10 and lift motor 18 coupled to the tilt carriage 28 according to the illustrative embodiment of the present invention. The lift arm extensions 34 rotatably couples with the lift shaft extensions 12 and 14 that extend from rear wheel carriage 10 along the lift axis. The cam follower 46 is shown in phantom below the cam arm extension 32. The tilt shaft 30 extends from the front of tilt carriage 28 and has slot 44 in the distal end 42. The ringed rib 40 is used to engage a slot in the tilt bearing (not shown) for retaining the tilt carriage 28 to the chassis. Also extending from the front surface of tilt carriage 28 are the two guide bosses 36, each of which has a guide tab 38 at its distal end. The relationship between the rotary cam 22 and the cam follower 46 can readily be appreciated in this view. Note also, the direction of rotation 26 of the rotary cam 22.

Figure 14:
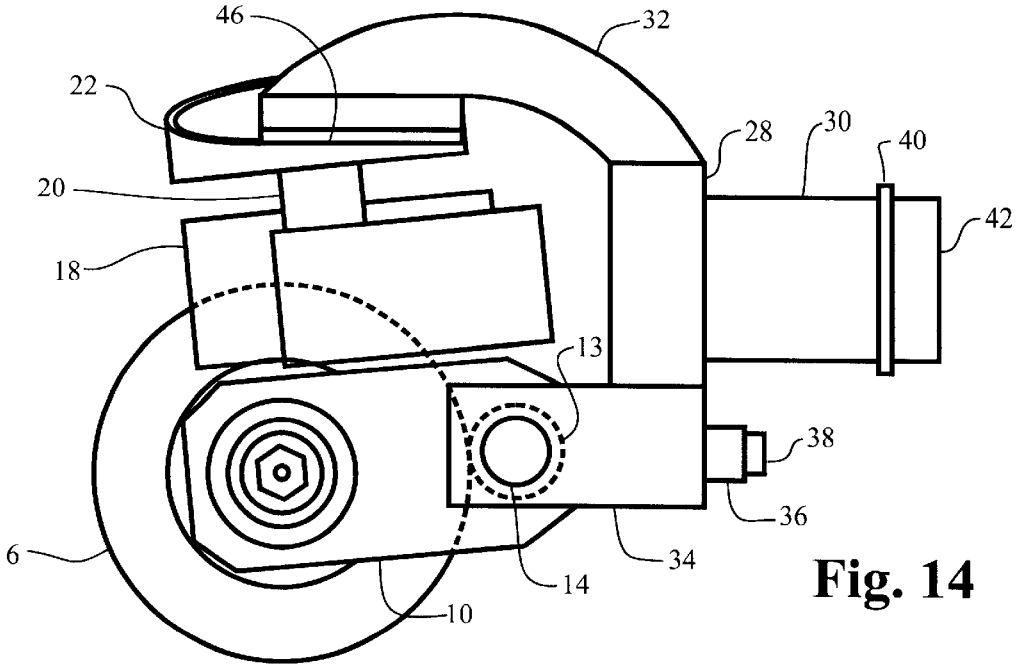
FIG. 14 is a side section view (along section lines "B—B" from FIG. 12) of the drive motor assembly and lift motor coupled to the tilt carriage in the lowered position according to an illustrative embodiment of the present invention.
Figure 15:
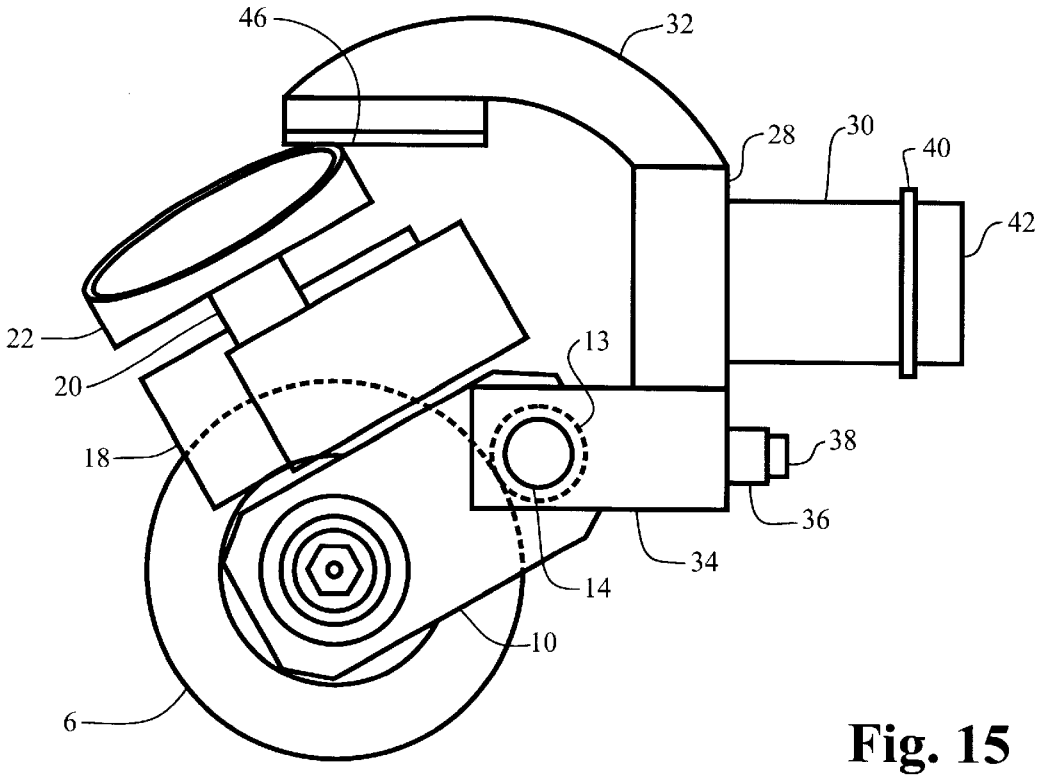
FIG. 15 is a side section view (along section lines "B—B" from FIG. 12) of the drive motor assembly and lift motor coupled to the tilt carriage in the raised position according to an illustrative embodiment of the present invention.

Reference is directed to FIG. 14, which is a side section view along section lines "B—B" from FIG. 12. It is a view of the drive motor assembly showing the rear wheel carriage and lift motor coupled to the tilt carriage in the lowered position according to the illustrative embodiment of the present invention. In this view, the shaft extension 14 from rear wheel carriage 10 can be seen engaging a bearing journal in the lift arm extension 34 of the tilt carriage 28. This rotatable coupling provides for rotation of the rear wheel carriage about the lift axis when actuated by the lift actuator. The cam arm extension 32 can be seen with cam follower 46 engaging the rotary cam 22. In the lowered position illustrated in this figure, the rotary cam 22 is positioned for the least amount of lift. As the lift motor operates, the rotary cam turns and the increasing height of the cam forces the distance between the rear wheel axle and the cam follower 46 further apart, thus producing rotation of the rear wheel carriage 10 about the lift axis, and the desired lift action. A comparison with FIG. 15, which is a side section view of the drive motor assembly and lift motor coupled to the tilt carriage in the raised position clearly shows this increased distance. As noted herein before, the rotary cam 22 is located eccentric with respect to lift motor shaft 20. Those skilled in the art will appreciate that the eccentric relationship produces two benefits. First, it increases the lift distance with a given diameter cam, and second, it assists in maintaining alignment of the cam edge directly under the cam follower 46. Without further structure, it can be appreciated that nothing retains the rear wheel assembly from freely dropping to it maximum extension if the model vehicle is lifted from the surface it rests upon. This may or may not he problematic. A rational stop can he provided to limit the extent of the drop. In the illustrative embodiment, a spring 13 is disposed about the lift axis running through lift shaft extensions 12 (not shown in FIG. 14) and 14 and the hearing journal on each side which is designed to urge the wheel assembly against the cam follower 46.

Again referring to FIGS. 14 and 15, the tilt shaft 30 extends from the front of tilt carriage 28. The tilt shaft 30 also has a slot 44 (not shown in FIGS. 14 and 15) in the distal end 42. The ringed rib 40 is used to engage a slot in the tilt bearing (not shown) for retaining the tilt carriage 28 to the chassis. Also extending from the front surface of tilt carriage 28 are the guide bosses 36, each of which has a guide tab 38 at its distal end. The interface between the tilt shaft and the chassis is best appreciated by referencing the following figures.

Figure 16:
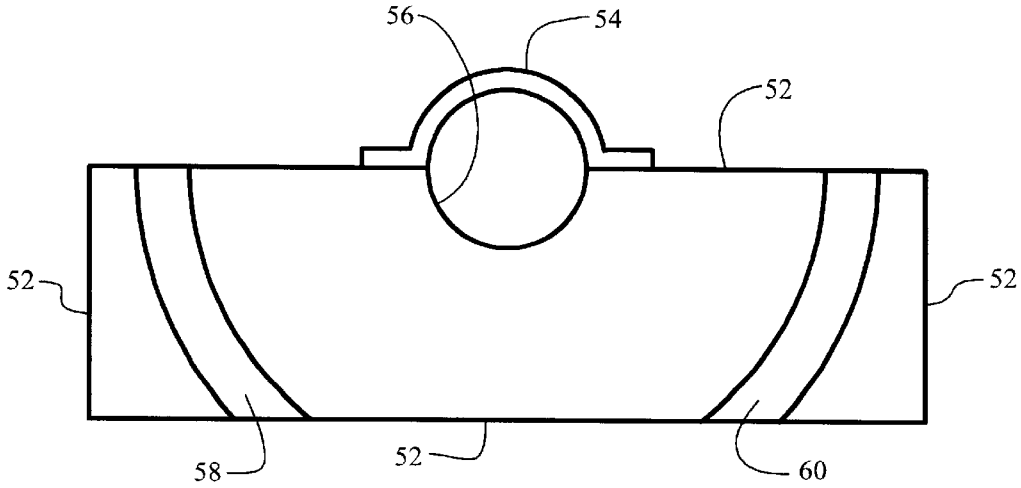
FIG. 16 is a back view of the model chassis portion that engages the tilt carriage according to an illustrative embodiment of the present invention.
Figure 17:
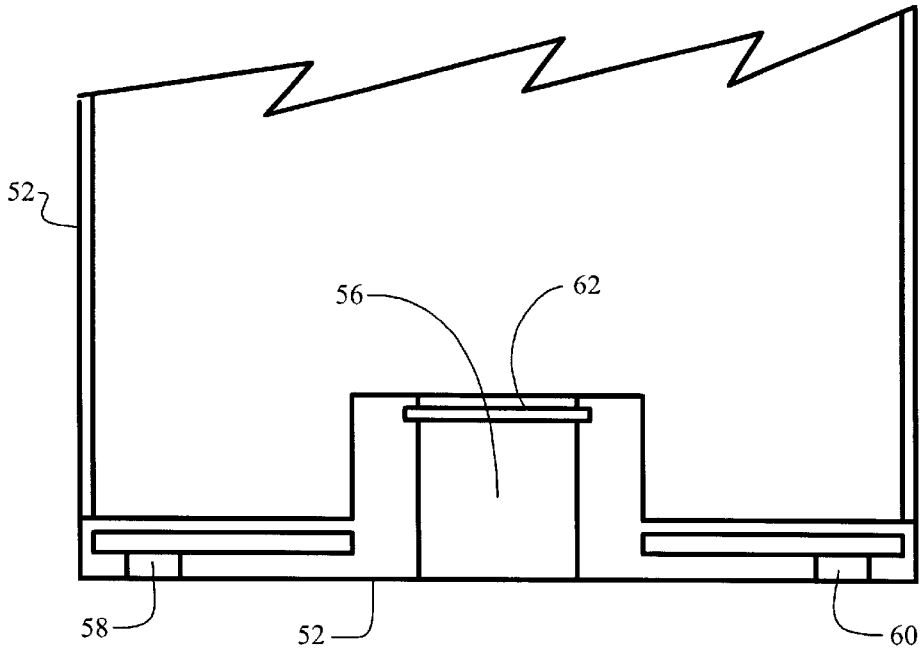
FIG. 17 is a top view of the model chassis portion that engages the tilt carriage according to an illustrative embodiment of the present invention.

Reference is directed to FIG. 16, which is a rear view of the chassis portion 52 that engages the tilt carriage 28 according to the illustrative embodiment of the present invention. The proportions and dimension of the chassis are dependent upon the design of the model vehicle, so the illustrations herein may not be typical of the multitude of implementation possible according to the present invention. A tilt bearing journal 56 is formed from a recess in chassis 52 in combination with a bearing cover 54. The internal diameter is sized to mate with the tilt shaft 30 that extends from the tilt carriage 28. Two guide slots 58 and 60 are formed into the rear surface of the chassis. These guide slots 58 and 60 engage the guide bosses 36 and guide tabs 38 that extend from the front of tilt carriage 28. FIG. 17 is a top view of the chassis portion 52 that engages the tilt carriage 28. The tilt bearing journal 56 is visible, the bearing cover 54 is not present in this view. A circular groove 62 is formed in the tilt bearing journal 56 (as well as the bearing cover 54) to engage the ringed rib 40 on the tilt shaft 30, discussed above. This arrangement retains the tilt shaft 30 in the tilt bearing journal 56. In addition, a pair of rotation stops may be added to limit the degree of tilt rotation of the tilt carriage about the tilt axis, which lies along the centerline of the tilt shaft 30 and tilt bearing journal 56. Note also in FIG. 17, the guide slots 58 and 60. The rearward opening of these slots is sized to accept the guide bosses 36. Toward the front of the guide slots, the opening enlarges to allow room for the guide tabs 38. In this fashion, the tilt carriage 28 is free to rotate, but is constrained from other movement by the tilt bearing journal 56 and the guide slots 58 and 60.

Figure 18:
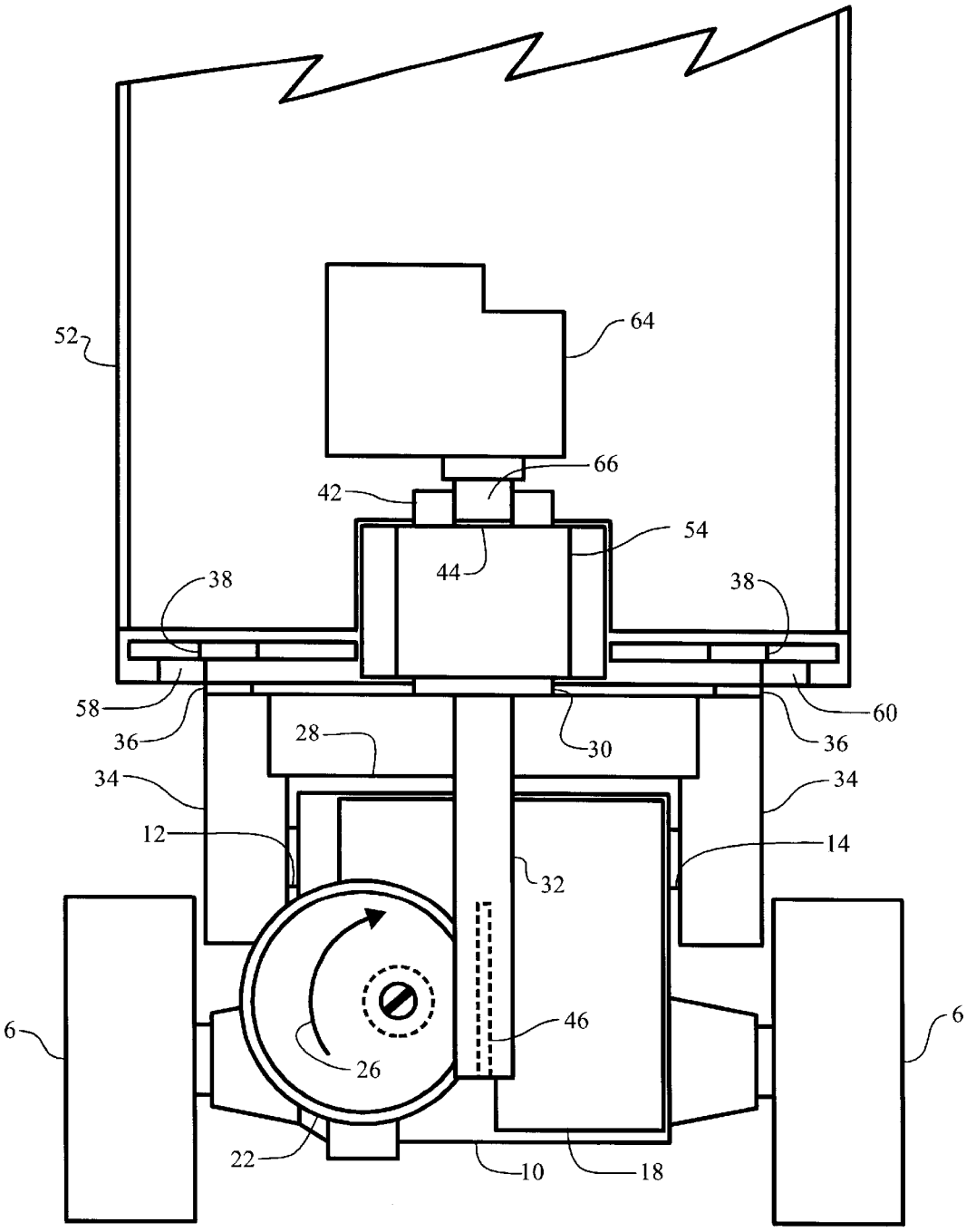
FIG. 18 is a top view of the drive motor assembly, lift motor, and tilt carriage coupled to the chassis, and showing the tilt servo according to an illustrative embodiment of the present invention.

FIG. 18 combines the rear wheel carriage 10, lift motor 18, tilt carriage 28, and adds the tilt actuator 64, to the chassis 52. FIG. 18 is a top view of the illustrative embodiment of the present invention. The rear wheels 6 can be seen coupled to the rear wheel carriage 10. The lift motor 18 is mounted thereupon with the rotary cam 22 engaging the cam follower 46, shown in phantom under the cam arm extension 32 of the tilt carriage 28. The lift shaft extensions 12 and 14 rotatably engage the lift arm extensions 34 of the tilt carriage 28. The tilt shaft 30 (barely visible) extends under the tilt bearing cover 54, which in combination with tilt bearing journal 56 (not visible) retains the tilt carriage 28 to the chassis 52. The distal end 42 of the tilt shaft 30 is visible, and includes the engagement slot 44. A tilt actuator 64 has an engagement tab 66 that couples to the engagement slot 44 in the distal end 42 of the tilt shaft 30. In the illustrative embodiment, the tilt actuator 64 is of conventional design, as understood by those skilled in the art, and can be actuated to rotate clockwise or counter-clockwise upon receipt of a suitable command. This results in the tilt-left and tilt-right action designed to emulate "hydraulics" in a full size vehicle. It will be appreciated by those skilled in the art that any of a number of tilt actuators or tilt actuator means could be employed, including, but not limited to, servo-controllers, motors, solenoids, cams, inclined planes, screws and other mechanisms. Also in FIG. 18, the guide slots 58 and 60 in chassis 52 are visible. The guide bosses 36 and guide tabs 38 can be seen. In this view, they do not align with the guide slots 58 and 60 because they are lower than the dominant plane of view, and are therefore offset by the degree of rotation the difference in planes defines.

Figure 19:
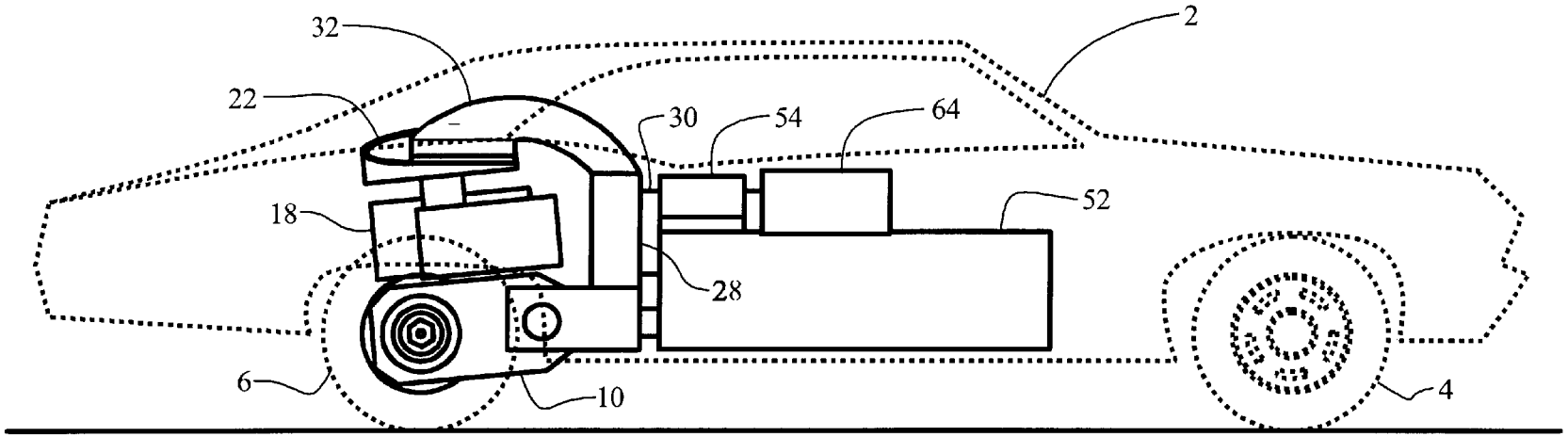
FIG. 19 is a side view of the drive motor assembly, lift motor, and tilt carriage coupled to the chassis, as located within the model vehicle according to an illustrative embodiment of the present invention.

FIG. 19 is a side view of the rear wheel carriage 10, lift motor 18, and tilt carriage 28 coupled to the chassis 52, as located within the model vehicle according to an illustrative embodiment of the present invention. The vehicle body outline 2 and front wheel 4 are shown in phantom to more clearly illustrate the internal components while still demonstrating the relationship between the two. The rear wheel 6 is also shown in phantom for the same reasons. The rear wheel carriage (or lift carriage) 10 rotates about the tilt axis (not numbered) running through tilt shaft 30 with respect to the tilt carriage 28. The lift motor 18 is shown together with the rotary lift cam 22 and the cam arm extension 32. The tilt bearing cap 54 generally locates the tilt axis, and the tilt actuator 64 is shown attached to the chassis 52. The tilt carriage can also be described as a sub-chassis. This view shows the lift carriage in the lowered position with no tilt applied to the tilt carriage.

Figure 20:
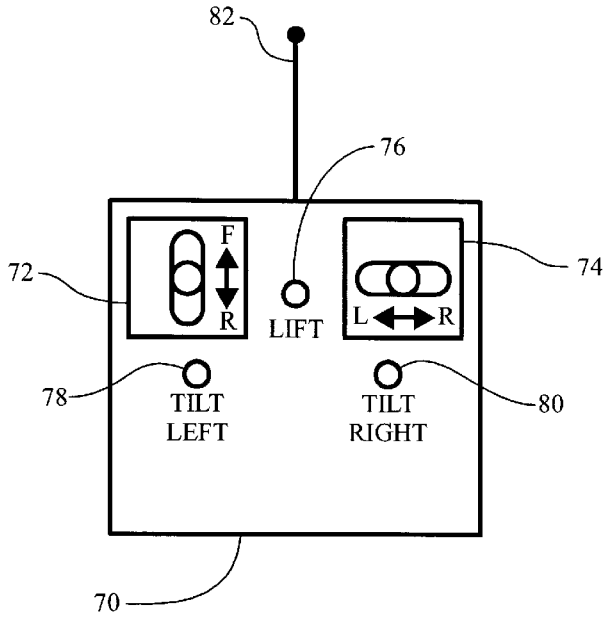
FIG. 20 is a front view of the remote control unit according to an illustrative embodiment of the present invention.

Reference is directed to FIG. 20, which is a front view of the remote control unit 70 according to an illustrative embodiment of the present invention. In the illustrative embodiment, the user of the model vehicle 2 operates the vehicle by radio remote control. Such devices are understood by those skilled in the art. The present invention teaches the addition of two classes of novel controls, including controls employed to adjust lift and controls employed to adjust tilt. In the illustrative embodiment, a single momentary contract actuator 76 is used so that the user can energize the lift motor. When lift control actuator 76 is actuated, a lift command is communicated to the model vehicle, which ultimately energizes the lift actuator, or motor in the illustrative embodiment. So long as the lift control actuator 76 is actuated, the lift actuator in the model vehicle continues to oscillate from maximum to minimum lift (the motor and lift cam continue to cycle). The user selects the desired lift level by de-actuating the lift control actuator 76 at the desired instant in time. In a similar fashion, the illustrative embodiment remote control unit 70 comprises two momentary contact actuators to control tilt. A tilt left control actuator 78 and a tilt right control actuator 80 are employed. When either of these control actuators are actuated, a tilt left or tilt right command, as the case may be, is communicated to the model vehicle. Either of these commands ultimately manifests themselves as tilt actuator rotation for left tilt and right tilt respectively. The remote control unit 70 also includes the conventional forward and reverse control 72 and the conventional left and right steering control 74, both of which are understood by those having ordinary skill in the art. The illustrative embodiment utilizes radio communications of remote control commands, so an antenna 82 extends from the remote control unit 70.

Figure 21:
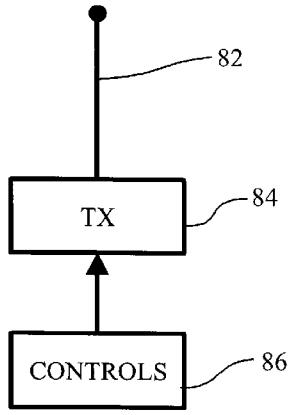
FIG. 21 is a functional block diagram of the remote control unit according to an illustrative embodiment of the present invention.

FIG. 21 is a functional block diagram of the remote control unit 70 according to an illustrative embodiment of the present invention. The aforementioned controls are represented by controls block 86. They are coupled to a radio transmitter 84, which is operable to transmit the lift, tilt left, tilt right, and the conventional remote control commands via radio communications over antenna 82. Those having ordinary skill in the art understand the functional operation of such radio remote control systems, including motor, and servo-motor control sequences.

Figure 22:
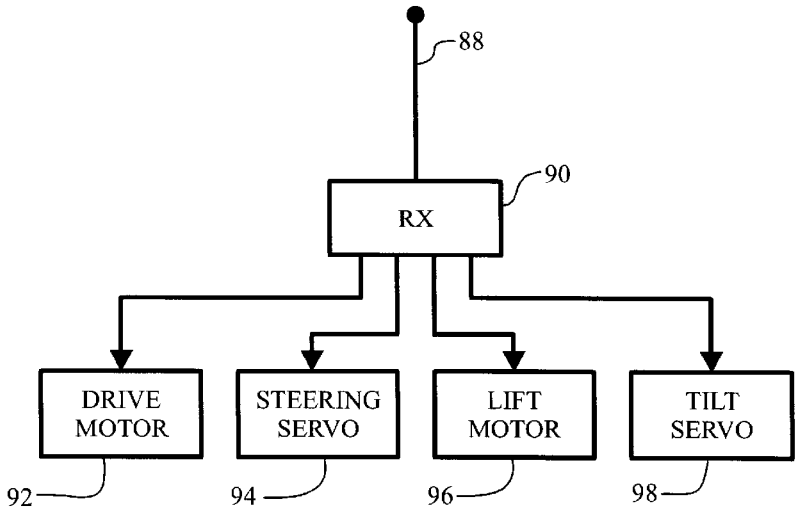
FIG. 22 is a functional block diagram of the model vehicle control circuits and mechanisms according to an illustrative embodiment of the present invention.

FIG. 22 is a functional block diagram of the model vehicle control circuits and mechanisms according to an illustrative embodiment of the present invention. A radio antenna 88 receives radio signals (not shown) that comprise the lift, tilt left, tilt right, and conventional remote control commands. A radio receiver 90 decodes the commands and directs them to the appropriate control mechanism. Those of ordinary skill in the art understand the design and function of such remote control receiver systems. The drive motor 92 receives and ultimately executes commands to move the model vehicle in the forward and reverse directions. The steering servo-motor 94 receives and ultimately executes commands to turn the front wheels to the right or left to effect steering of the model vehicle. The lift motor 96 (shown as lift motor 18 in other figures) receives and ultimately executes lift commands by actuating the lift actuator to adjust lift to effect the lift action in the model vehicle. The tilt servo-motor 98 (shown as tilt actuator 64 in other figures) receives and ultimately executes the tilt left and tilt right commands to effect the tilting action of the model vehicle.

Thus, the present invention has been described herein with reference to a particular embodiment for a particular application. Those having ordinary skill in the art and access to the present teachings will recognize additional modifications, applications and embodiments within the scope thereof It is therefore intended by the appended claims to cover any and all such applications, modifications and embodiments within the scope of the present invention.

Accordingly,

What is claimed is:

1. A model vehicle having a suspension operable to vary the tilt of the vehicle, comprising:

a chassis;

a tilt carriage rotatably coupled to said chassis about a longitudinally aligned tilt axis by a combination tilt bearing and tilt shaft;

a wheel axle rotatably supported said tilt carriage and oriented substantially perpendicular with respect to said tilt axis; and a tilt actuator coupled to said chassis and said tilt carriage, wherein actuation thereof varies the angle of rotation of said tilt carriage, said tilt actuator having a rotary output driver coupled to said tilt shaft for imparting rotation thereof.

2. The apparatus in claim 1 wherein said tilt carriage is a servo operable to impart rotation about said tilt axis.

3. The apparatus of claim 2 further comprising a remote control receiver coupled to control said servo upon receipt of a tilt commands.

4. The apparatus in claim 3 further comprising a remote control unit having a first tilt input actuator coupled to a remote control transmitter, and wherein actuation of said first tilt input actuator causes said transmitter to transmit a first tilt command.

5. The apparatus in claim 4 and wherein said remote control transmitter transmits said first tilt command by radio signal.

6. The apparatus of claim 4 and wherein said first tilt command causes said servo to rotate in a first direction, and wherein said remote control transmitter further comprises a second input tilt actuator coupled to said remote control transmitter, and wherein actuation of said second tilt input actuator causes said transmitter to transmit a second tilt command, and wherein said second tilt command causes said servo to rotate in a second direction.

7. The apparatus of claim 1, and wherein said chassis has at least a first guide slot arcuately formed therein about a constant radius from said tilt axis, and said tilt carriage has at least a first guide boss extending therefrom that rotatably engages said at least a first guide slot.

8. A model vehicle having a suspension operable to vary the tilt and the lift of the model vehicle, comprising:

a chassis, defining a longitudinal direction and a lateral direction;

a sub-chassis defining a longitudinally aligned first axis aligned substantially perpendicular to a laterally aligned second axis;

a rotatable coupling between said chassis and said sub-chassis aligned with said first axis;

a first actuator coupled to said chassis and said sub-chassis, wherein actuation thereof varies the angle of rotation of said sub-chassis about said first axis, thereby varying the tilt of the vehicle;

a wheel carriage rotatably coupled to said sub-chassis about said second axis;

a second actuator coupled to said sub-chassis and said wheel carriage, wherein actuation thereof varies the angle of rotation of said wheel carriage about said second axis, thereby varying the lift of the vehicle, and a wheel axle supported by said wheel carriage and aligned substantially parallel with said second axis.

9. The apparatus in claim 8 and wherein:

said second actuator further comprises a cam follower, and a motor driven cam aligned to rotatably engage said cam follower thereby producing an oscillating rotation about said second axis when said motor driven cam operates, and said first actuator comprises a servo coupled to said chassis and said sub-chassis to impart rotation therebetween about said first axis.

10. The apparatus of claim 9 and wherein said motor driven cam is eccentric.

11. The apparatus of claim 8, further comprising a spring disposed between said sub-chassis and said wheel carriage and arranged to urge rotation about said second axis in opposition to rotation by said second actuator.

12. The apparatus in claim 8 and wherein said sub-chassis is rotatably coupled to said chassis about said first axis by a combination bearing and shaft.

13. The apparatus of claim 8, and wherein said chassis has at least a first guide slot arcuately formed therein about a constant radius from said first axis, and said sub-chassis has at least a first guide boss extending therefrom that rotatably engages said at least a first guide slot.

14. The apparatus of claim 9 further comprising:

a remote control receiver coupled to energize said motor driven cam upon receipt of a lift command, and coupled to control said servo upon receipt of one or more tilt commands.

15. The apparatus in claim 14 further comprising:

a remote control transmitter;

a lift input actuator coupled to said remote control transmitter, and wherein actuation of said lift input actuator causes said transmitter to transmit a lift command; and a first tilt input actuator coupled to said remote control transmitter, and wherein actuation of said first tilt input actuator causes said transmitter to transmit a first tilt command.

16. The apparatus in claim 15 and wherein said remote control transmitter transmits said lift command and said first tilt command by radio signal.

17. The apparatus of claim 16 and wherein said first tilt command causes said tilt servo to rotate in a first direction, and wherein said remote control transmitter further comprises a second input tilt actuator coupled to said remote control transmitter, and wherein actuation of said second tilt input actuator causes said remote control transmitter to transmit a second tilt command, and wherein said second tilt command causes said servo to rotate in a second direction.

18. A model vehicle having a suspension operable to vary the lift of the vehicle, comprising:

a chassis;

a lift carriage rotatably coupled to said chassis about a laterally aligned lift axis;

a wheel axle rotatably supported by said lift carriage and oriented substantially parallel to said lift axis; and a lift actuator coupled to said chassis and said lift carriage, said lift actuator further comprising a cam follower and a motor driven eccentric cam aligned to rotatably engage said cam follower, wherein actuation of said lift actuator causes said motor driven cam to rotate and vary the angle of rotation of said lift carriage, thereby producing an oscillating rotation about said lift axis;

a spring disposed between said chassis and said lift carriage and arranged to urge rotation about said lift axis to engage said cam follower and said motor driven eccentric cam;

a remote control radio receiver coupled to energize said motor driven eccentric cam upon receipt of a lift command, and a remote control unit having a lift input actuator coupled to a remote control radio transmitter, and wherein actuation of said lift input actuator causes said transmitter to transmit a lift command to said remote control receiver by radio waves.

* * * * *